US008555839B2

(12) United States Patent
Kawai et al.

(10) Patent No.: US 8,555,839 B2
(45) Date of Patent: Oct. 15, 2013

(54) VALVE-MECHANISM-EQUIPPED ENGINE

(75) Inventors: Toru Kawai, Wako (JP); Yoshikazu Sato, Wako (JP); Keita Ito, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 173 days.

(21) Appl. No.: 13/227,089

(22) Filed: Sep. 7, 2011

(65) Prior Publication Data

US 2012/0067314 A1 Mar. 22, 2012

(30) Foreign Application Priority Data

Sep. 16, 2010 (JP) ..... 2010-208565

(51) Int. Cl.
*F01L 1/02* (2006.01)
*F01L 1/00* (2006.01)

(52) U.S. Cl.
USPC ..... 123/90.31; 123/90.21

(58) Field of Classification Search
USPC ..... 123/90.21, 90.31
See application file for complete search history.

(56) References Cited

U.S. PATENT DOCUMENTS 4,305,352 A * 12/1981 Oshima et al. ..... 123/90.15
4,974,560 A * 12/1990 King ..... 123/90.17
5,816,208 A * 10/1998 Kimura ..... 123/182.1
6,748,913 B2 * 6/2004 Nakayama ..... 123/90.21
7,228,833 B2 * 6/2007 Klotz ..... 123/90.39
2005/0022768 A1 * 2/2005 Tores et al. ..... 123/90.41
2009/0320792 A1 * 12/2009 Kashima ..... 123/347
2010/0071646 A1 * 3/2010 Kono et al. ..... 123/90.31
2011/0017159 A1 * 1/2011 Schneiker ..... 123/90.23

FOREIGN PATENT DOCUMENTS

JP 2006-152941 A 6/2006

OTHER PUBLICATIONS

Merriam-Webster online dictionary definition of "inclined" (accessed Jun. 5, 2013).*

* cited by examiner

*Primary Examiner* — Kenneth Bomberg
*Assistant Examiner* — Ngoc T Nguyen
(74) *Attorney, Agent, or Firm* — Westerman, Hattori, Daniels & Adrian, LLP

(57) ABSTRACT

A valve-mechanism-equipped engine having increased combustion efficiency is disclosed. The engine includes intake and exhaust rocker arms having a swing center line inclined relative to a rotation center line of a cam, and an intake valve and an exhaust valve inclined relative to a cylinder. A cam surface is inclined relative to the rotation center line of the cam. Slippers of the intake and exhaust rocker arms are in sliding contact with the cam surface.

3 Claims, 9 Drawing Sheets

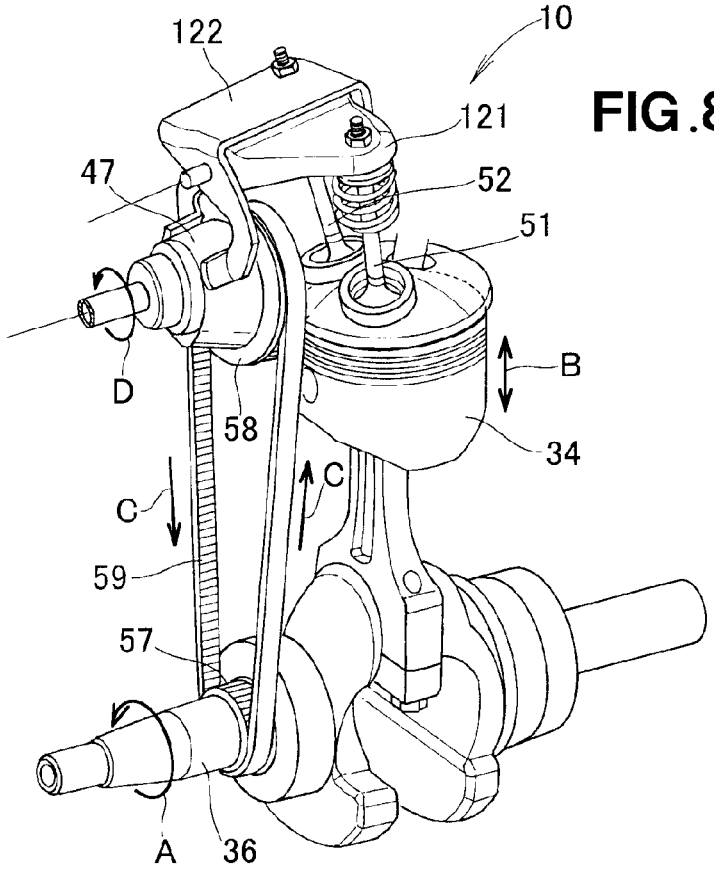
FIG.8A
FIG.8B
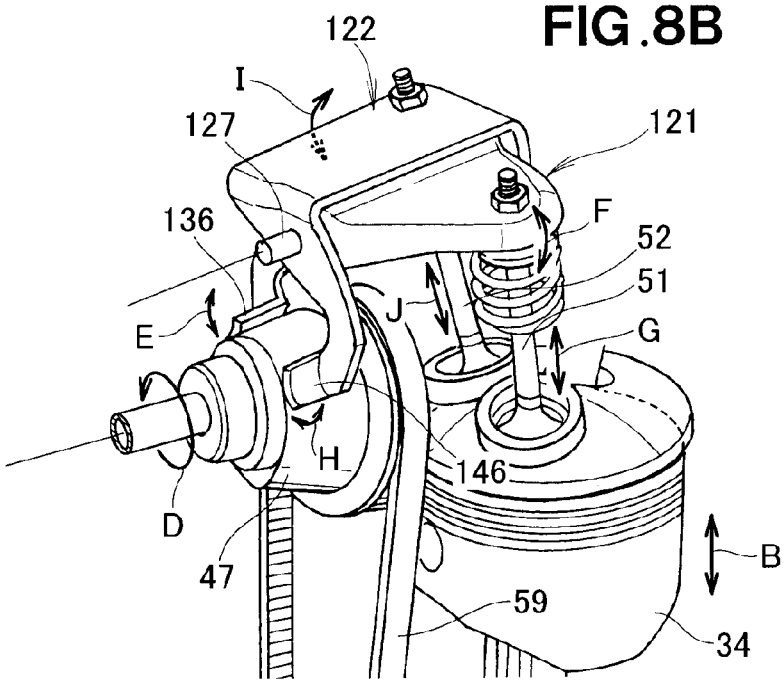

VALVE-MECHANISM-EQUIPPED ENGINE

FIELD OF THE INVENTION

The present invention relates to a valve-mechanism-equipped engine wherein an intake valve and an exhaust valve of a combustion chamber are operated by driving a cam member to open and close the combustion chamber.

BACKGROUND OF THE INVENTION

Small general-use overhead camshaft (OHC) engines in which an intake valve and an exhaust valve are driven to be opened and closed by driving a valve mechanism are known as valve-mechanism-equipped engines, an example of which is disclosed in Japanese Patent Application Laid-Open Publication No. 2006-152941. This valve-mechanism-equipped engine is provided with an intake rocker arm for driving the intake valve to open and close the valve, an exhaust rocker arm for driving the exhaust valve to open and close the valve, a cam member for driving the intake and exhaust rocker arms, and a transmission belt for transmitting the motive power of a crankshaft to the cam member.

In the valve-mechanism-equipped engine disclosed in Japanese Laid-open Patent Publication No. 2006-152941, the rotation of the crankshaft is transmitted to the cam member via the transmission belt to rotate the cam member, whereby the intake rocker arm and the exhaust rocker arm are made to swing. When the intake rocker arm and the exhaust rocker arm are made to swing, the intake valve and the exhaust valve can be opened and closed.

In a valve-mechanism-equipped engine, the shape of the combustion chamber, the location of the intake valve and exhaust valve, the location of the spark plug, and other factors are known to affect the combustion efficiency inside the combustion chamber.

However, since the valve-mechanism-equipped engine according to Japanese Laid-open Patent Publication No. 2006-152941 is a small general-use engine, there are selectivity limitations on, among other factors, the shape of the combustion chamber, the location of the intake valve and exhaust valve, and the location of the spark plug; and such limitations are a hindrance to increasing combustion efficiency.

SUMMARY OF THE INVENTION

An object of the present invention is to provide a valve-mechanism-equipped engine adapted to operate at increased combustion efficiency.

According to a first aspect of the present invention, there is provided a valve-mechanism-equipped engine comprising an intake rocker arm for opening and closing an intake valve of a combustion chamber, an exhaust rocker arm for opening and closing an exhaust valve of the combustion chamber, a cam for driving the intake rocker arm and the exhaust rocker arm, and transmission means for transmitting motive power of a crankshaft to the cam, wherein a swing center line of the intake rocker arm and the exhaust rocker arm is inclined relative to a rotation center line of the cam, and a cam surface of the cam is inclined relative to the rotation center line of the cam, slippers in sliding contact with the cam surface are provided to the intake rocker arm and the exhaust rocker arm; and the slippers are guided by the cam surface such that the intake rocker arm and the exhaust rocker arm swing about the swing center line.

In the present invention, the swing center line of the intake rocker arm and the swing center line of the exhaust rocker arm are thus inclined relative to the rotation center line of the cam. The intake valve and the exhaust valve can therefore be inclined relative to the center line of the cylinder. Inclining the intake valve and the exhaust valve relative to the center line of the cylinder allows the combustion chamber to be formed in a substantially hemispherical shape, and the intake valve and the exhaust valve to be disposed in the direction of a normal to the combustion chamber. The intake valve and the exhaust valve can thereby be aligned with the combustion chamber, and the surface area of the combustion chamber can be minimized or the flame-quenching part (quenching zone) can be reduced.

It is generally known that shaping the combustion chamber to a minimum surface area and reducing the flame-quenching part (quenching zone) are important factors that allow the fuel to burn with high efficiency inside the combustion chamber. Minimizing the surface area of the combustion chamber or reducing the flame-quenching part (quenching zone) can thereby increase the combustion efficiency of the engine.

Moreover, inclining the intake valve and the exhaust valve relative to the center line of the cylinder allows the intake valve and the exhaust valve to be disposed clear of (offset from) the center line of the cylinder. The ignition part of the spark plug can therefore be provided on the center line of the combustion chamber and the cylinder, or in the vicinity of the center line.

It is usually known that providing the ignition part of the spark plug on the center line of the combustion chamber and the cylinder or in the vicinity of the center line is an important factor that allows the fuel to burn with high efficiency inside the combustion chamber. Providing the ignition part of the spark plug on the center line of the combustion chamber and the cylinder or in the vicinity of the center line can thereby increase the combustion efficiency of the engine.

In addition, the cam surface is inclined relative to the rotation center line of the cam, and the slippers of the intake rocker arm and the exhaust rocker arm are brought into sliding contact with the cam surface. Moving the cam along the rotation center line allows the increase and decrease in the valve lift rate (ascending/descending rate) of the intake valve and the exhaust valve to be adjusted, and allows the cam to perform the role of a lash adjuster mechanism. The lash adjuster mechanism is a mechanism for appropriately maintaining the characteristics of the engine by adjusting the clearance in cases in which, for example, the peripheral components of the cam have a large clearance.

The transmission means preferably has a driving pulley provided to the crankshaft, a driven pulley provided coaxially with the rotation center line of the cam, and a transmission belt wrapped around the driving pulley and the driven pulley; and the driven pulley is provided in a direction of the combustion chamber in relation to the cam. Accordingly, the driven pulley and the transmission belt can be brought closer to the cylinder. The valve system can thus be made compact because the driven pulley and the transmission belt can be brought closer to the cylinder.

Moreover, disposing the driven pulley near the combustion chamber allows the cam to be disposed away from the combustion chamber. Arranging the cam away from the combustion chamber allows the effects of heat to be mitigated, a tapered shape to be obtained by inclining the cam surface, and the driven pulley and the cam to be integrally molded. The number of components can thereby be reduced, and the valve system can be made more compact.

A surface in the combustion chamber that is opposite a piston of a cylinder is preferably formed in a substantially hemispherical shape, and an intake port opened and closed by the intake valve and an exhaust port opened and closed by the exhaust valve are formed in a direction of a normal to the substantially hemispherical surface. Accordingly, forming the combustion chamber in an approximately hemispherical shape allows the combustion chamber to be shaped to a minimum surface area. Also, disposing the intake valve and the exhaust valve in the direction of a normal to the combustion chamber allows the seat surface of the intake valve and the exhaust valve to be aligned with the front surface of the combustion chamber.

It is known that shaping the combustion chamber to a minimum surface area and aligning the seat surface of the intake valve and the exhaust valve with the front surface of the combustion chamber are important factors that allow the fuel to burn with high efficiency inside the combustion chamber. Shaping the combustion chamber to a minimum surface area and aligning the seat surface of the intake valve and the exhaust valve with the front surface of the combustion chamber can thereby increase the combustion efficiency of the engine.

The substantially hemispherical surface is preferably provided with a spark plug on a center line of the combustion chamber and the cylinder or in the vicinity of the center line. It is known that providing the ignition part of the spark plug on the center line of the combustion chamber and the cylinder or in the vicinity of the center line is an important factor that allows the fuel to burn with high efficiency inside the combustion chamber. Providing the spark plug on the center line of the combustion chamber and the cylinder or in the vicinity of the center line can thereby increase the combustion efficiency of the engine.

BRIEF DESCRIPTION OF THE DRAWINGS

A preferred embodiment of the present invention will be described in detail below, by way of example only, with reference to the accompanying drawings, in which:

FIGS. 8A and 8B are views illustrating an example operation of the intake valve and the exhaust valve of the valve mechanism shown in FIG. 4.

DETAILED DESCRIPTION OF THE PREFERRED EMBODIMENT

Figure 1:
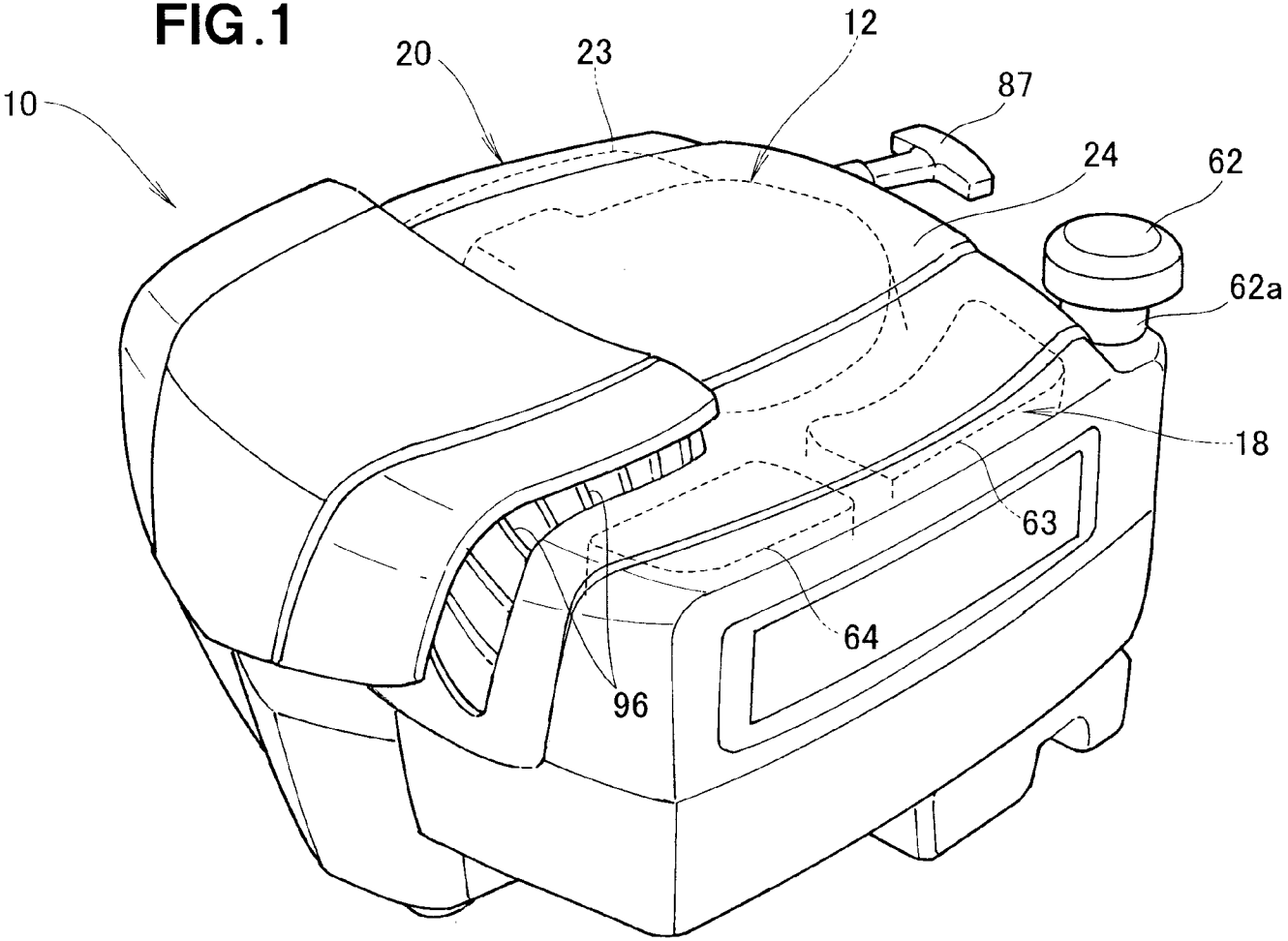
FIG. 1 is a perspective view illustrating a valve-mechanism-equipped engine according to an embodiment of the present invention.
Figure 2:
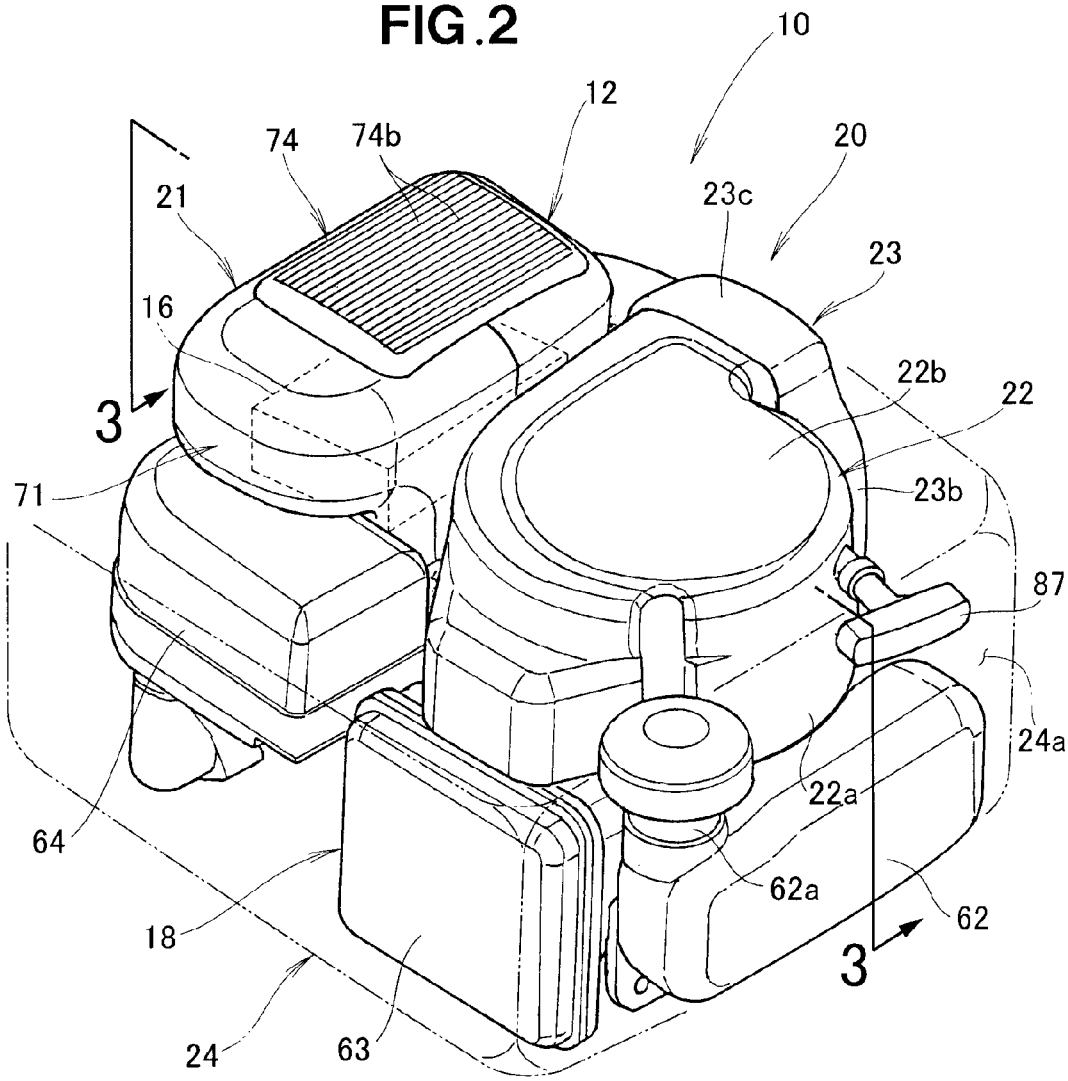
FIG. 2 is a perspective view illustrating the valve-mechanism-equipped engine of FIG. 1, with an outer cover removed.

A valve-mechanism-equipped engine 10 according to the present embodiment is a general-use liquid-cooled engine provided with an engine assembly 12 including an engine body 14 (FIG. 3), a radiator 16, and the like; and a cover structure 20 for covering the engine assembly 12, as shown in FIGS. 1 and 2. A general-use water-cooled engine is an example of a general-use liquid-cooled engine.

Figure 3:
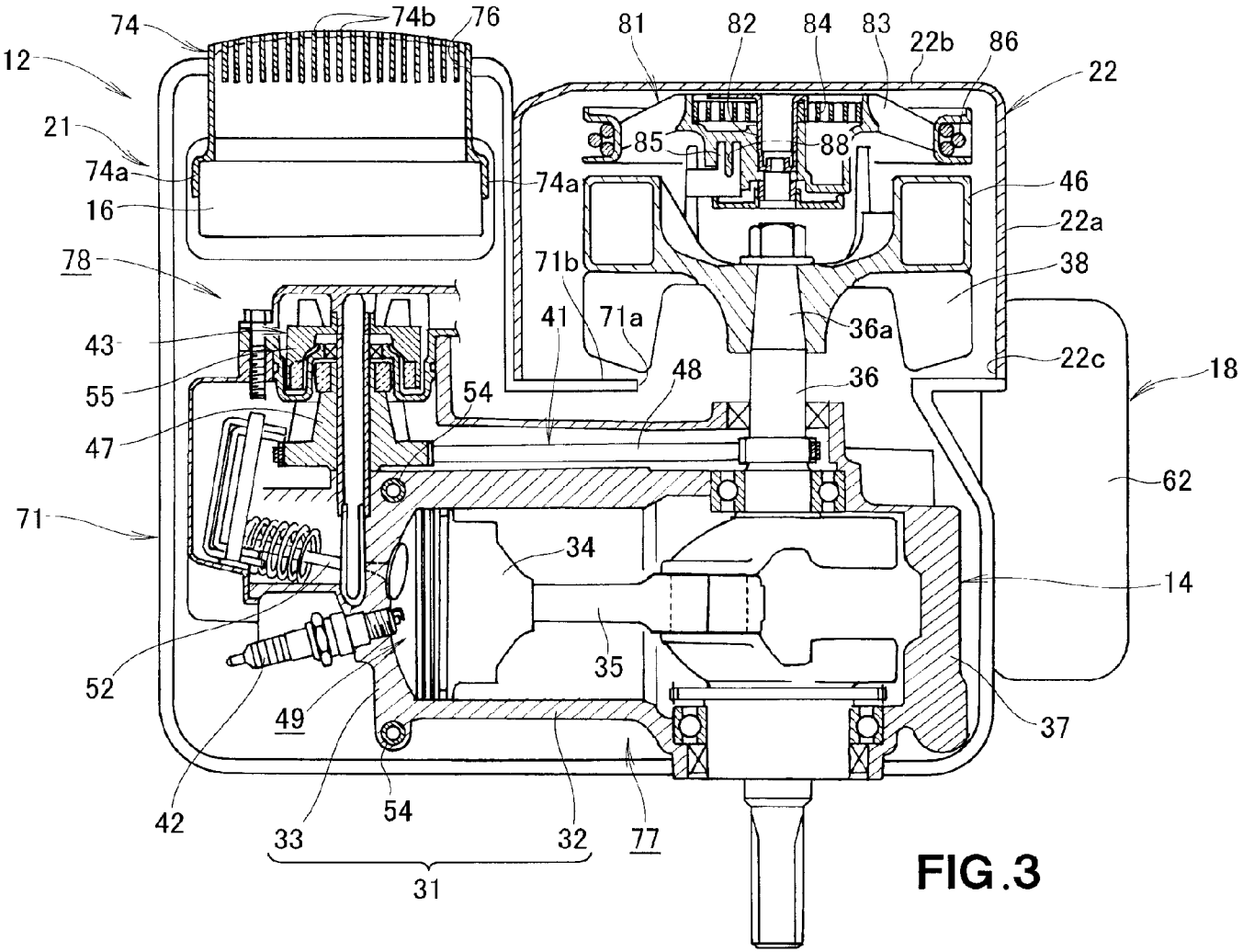
FIG. 3 is a cross-sectional view taken along line 3-3 in FIG. 2.

The engine assembly 12 has the engine body 14 in which a piston 34 is provided to the inside of a cylinder block 32 of a cylinder block/head 31, and also has the radiator 16 for cooling the engine body 14, as well as peripheral equipment 18 provided to the periphery of the engine body 14, as shown in FIG. 3.

The cylinder block 32 and a cylinder head 33 are integrally molded in the cylinder block/head 31 of the engine body 14. In the engine body 14, the piston 34 is provided to the inside of the cylinder block 32, a crankshaft 36 is linked to the piston 34 via a connecting rod 35, and the crankshaft 36 is covered by a crankcase 37.

In the engine body 14, a cooling fan 38 is provided to an end part 36*a* of the crankshaft 36 protruding from the crankcase 37, a valve mechanism 41 is provided to the cylinder head 33 and the cylinder block/head 31, and a spark plug 42 and cooling means 43 are provided to the cylinder head 33.

The cooling fan 38 is coaxially provided to the flywheel 46. The flywheel 46 is coaxially provided to the end part 36*a* of the crankshaft 36 and is thereby disposed above the crankcase 37. The cooling fan 38 is therefore coaxially provided to the end part 36*a* of the crankshaft 36 and disposed above the crankcase 37.

Cooling air introduced from the outside is directed to the radiator 16 by the rotation of the cooling fan 38, and the cooling air that has cooled the radiator 16 is directed to a muffler. The flywheel 46 ensures smooth rotation of the crankshaft 36.

The valve mechanism 41 is provided with transmission means 48 for transmitting the rotation of the crankshaft 36 to a cam member (cam) 47, an intake valve 51 (refer to FIG. 4) and an exhaust valve 52 for opening and closing a combustion chamber 49 by the rotation of the cam member 47, and other members relating to the valve mechanism 41.

According to the valve mechanism 41, the rotation of the crankshaft 36 is transmitted to the cam member 47 by the transmission means 48, whereby the cam member 47 is rotated. The intake valve 51 and the exhaust valve 52 are operated by the rotation of the cam member 47. The valve mechanism 41 is described in detail in FIGS. 4 to 7.

The cooling means 43 is provided with a cooling channel 54 embedded (cast) in the circumference of the cylinder head 33 and arranged having communication with the radiator 16, and a water pump 55 and a thermostat (not shown) provided in the middle of the cooling channel 54. The water pump 55 is provided above the cylinder head 33 and linked to the transmission means 48. The rotation of the crankshaft 36 is therefore transmitted to the water pump 55 via the transmission means 48, and the water pump 55 is rotated.

The radiator 16 has the same structure as a generally used engine-cooling radiator. The radiator 16 is provided above the water pump 55 and adjacent to the cooling fan 38. Causing the cooling fan 38 to rotate therefore allows the suction force of the cooling fan 38 to be applied to the radiator 16, and the cooling air to pass through the radiator 16.

The cooling channel 54 (part of the cooling channel is not shown) of the cooling means 43 is in communication with the radiator 16. The cooling liquid that has cooled the engine body 14 is therefore circulated through the radiator 16 by way of the cooling channel 54. The cooling liquid can be cooled in the radiator 16 by circulating the cooling liquid that has cooled the engine body 14 through the radiator 16.

Specifically, according to the cooling means 43 and the radiator 16, the cooling liquid is circulated inside the cooling channel 54 by the water pump 55, allowing the engine body 14 to be cooled by the cooling liquid.

Operation of the thermostat, which is not shown, causes the cooling liquid that has cooled the engine body 14 to be circulated through the engine body 14 by way of the water pump 55 when the cooling liquid does not rise to a specified temperature.

In contrast, operation of the thermostat causes the cooling liquid that has cooled the engine body 14 to be directed to the radiator 16 by way of the water pump 55 when the cooling liquid rises to a specified temperature. The cooling liquid thus directed is cooled in the radiator 16, and the cooled cooling liquid is circulated through the engine body 14 and caused to cool the engine body 14.

The peripheral equipment 18 includes a muffler provided to the periphery of the engine body 14, a fuel tank 62, an oil tank 63, and an air cleaner 64, as shown in FIGS. 1 and 2. The peripheral equipment 18 is covered by the cover structure 20.

The cover structure 20 is provided with an engine cover 21 for covering the engine body 14 and the radiator 16, a recoil cover 22 for covering the cooling fan 38 of the engine body 14, a muffler cover 23 for covering the muffler of the peripheral equipment 18, and an outer cover 24 for covering the engine assembly 12, as shown in FIGS. 2 and 3.

The engine cover 21 is provided with a cover body 71 for covering the engine body 14 and the radiator 16, and a radiator guard 74 provided to the cover body 71. The cover body 71 is formed in an approximate L-shape in side view, and has a cooling-air inlet 76 for introducing cooling air to the inside. The radiator 16 is supported by the cooling-air inlet 76 via a supporting region 74*a* of the radiator guard 74. The radiator 16 is supported by the cooling-air inlet 76, whereby the cooling air received from the cooling-air inlet 76 is conducted to the radiator 16.

The radiator guard 74 has a guard louver 74*b* formed in a region incorporated into the cooling-air induction port 76. A plurality of louver units is provided at specific intervals in the guard louver 74*b*. The cooling air can therefore be introduced to an upper accommodating space 78 of the cover body 71 from the outside of the engine cover 21 by way of the guard louver 74*b* (specifically, the cooling-air inlet 76). Moreover, the guard louver 74*b* is formed in the radiator guard 74, whereby the radiator 16 can be protected by the radiator guard 74.

The cooling fan 38 is disposed adjacent to the area above a ceiling 71*b* of the cover body 71. A cover opening 71*a* is formed in the ceiling 71*b*. Forming the cover opening 71*a* allows the cooling fan 38 to be in communication with an accommodating space 77 of the cover body 71 by way of the cover opening 71*a*.

The cooling fan 38 is covered by the recoil cover 22. The recoil cover 22 has a circumferential wall 22*a* formed along the outer circumference of the cooling fan 38, a top part 22*b* for blocking an upper end part of the circumferential wall 22*a*, and a lower opening 22*c* in a lower end part of the circumferential wall 22*a*.

The lower opening 22*c* of the recoil cover 22 is positioned opposite to (facing) the cover opening 71*a*. The lower opening 22*c* of the recoil cover 22 is therefore kept in communication with the cooling-air inlet 76 by way of the cover opening 71*a*, the accommodating space 77, and the upper accommodating space 78.

The radiator 16 is provided to the cooling-air inlet 76 and disposed adjacent to the cooling fan 38. The cooling air is therefore adequately directed to the cooling-air inlet 76 (specifically, the radiator 16) by the rotation of the cooling fan 38. The cooling liquid inside the radiator 16 can thereby be suitably cooled by the cooling air, and the general-use liquid-cooled engine 10 can be efficiently cooled by the cooled cooling liquid.

An engine start-up recoil starter 81 is built into the recoil cover 22. The recoil starter 81 is provided with a support shaft 82 provided to the top part 22*b* of the recoil cover 22, a pulley 83 rotatably supported by the support shaft 82, a recoil spring 84 linked to the pulley 83 and the support shaft 82, a one-way clutch 85 provided to the pulley 83, a cable 86 in which the proximal end is linked to the pulley 83 and wrapped around the outer circumference of the pulley, and a recoil knob 87 (FIG. 1) provided to the distal end of the cable 86.

The support shaft 82 extends toward the crankshaft 36 and is disposed coaxially with the crankshaft 36. A locking claw (not shown) in the one-way clutch 85 is locked to a locking groove 88 of the flywheel 46. The recoil knob 87 can therefore be grasped and pulled by a hand, causing the pulley 83 to rotate against the spring force of the recoil spring 84. The crankshaft 36 is rotated via the flywheel 46 by the rotation of the pulley 83. Rotating the crankshaft 36 causes the general-use liquid-cooled engine 10 to start up. Starting up the general-use liquid-cooled engine 10 causes the locking claw to separate from the locking groove 88 of the flywheel 46. Releasing the hand from the recoil knob 87 allows the pulley 83 to be rotated by the spring force of the recoil spring 84, and the cable 86 to be wrapped around the pulley 83.

The outer cover 24 is formed in an approximate rectangular shape so as to cover the engine assembly 12, as shown in FIGS. 1 and 2. The outside cover 24 has an outside louver 96 formed in a region corresponding to the radiator guard 74. A plurality of louver units is provided at specific intervals in the outer louver 96. Outside air can be directed as cooling air to the inside of the outer cover 24 from the outside of the outer cover 24 because the outer louver 96 is formed in a region corresponding to the radiator guard 74.

Cooling air directed to the inside of the outer cover 24 can be directed to the upper accommodating space 78 of the engine cover 21 by way of the guard louver 74*b* (cooling-air inlet 76) of the radiator guard 74, as shown in FIG. 3. Directing the cooling air to the upper accommodating space 78 allows the cooling air thus directed to be able to pass through the radiator 16. Directing the cooling air to the radiator 16 allows the cooling liquid inside the radiator 16 to be cooled.

The valve mechanism 41 will be described next with reference to FIGS. 4 to 7. The engine body 14 is shown in an upright state in FIGS. 4 to 7 in order to facilitate easier understanding of the structure of the valve mechanism 41.

Figure 4:
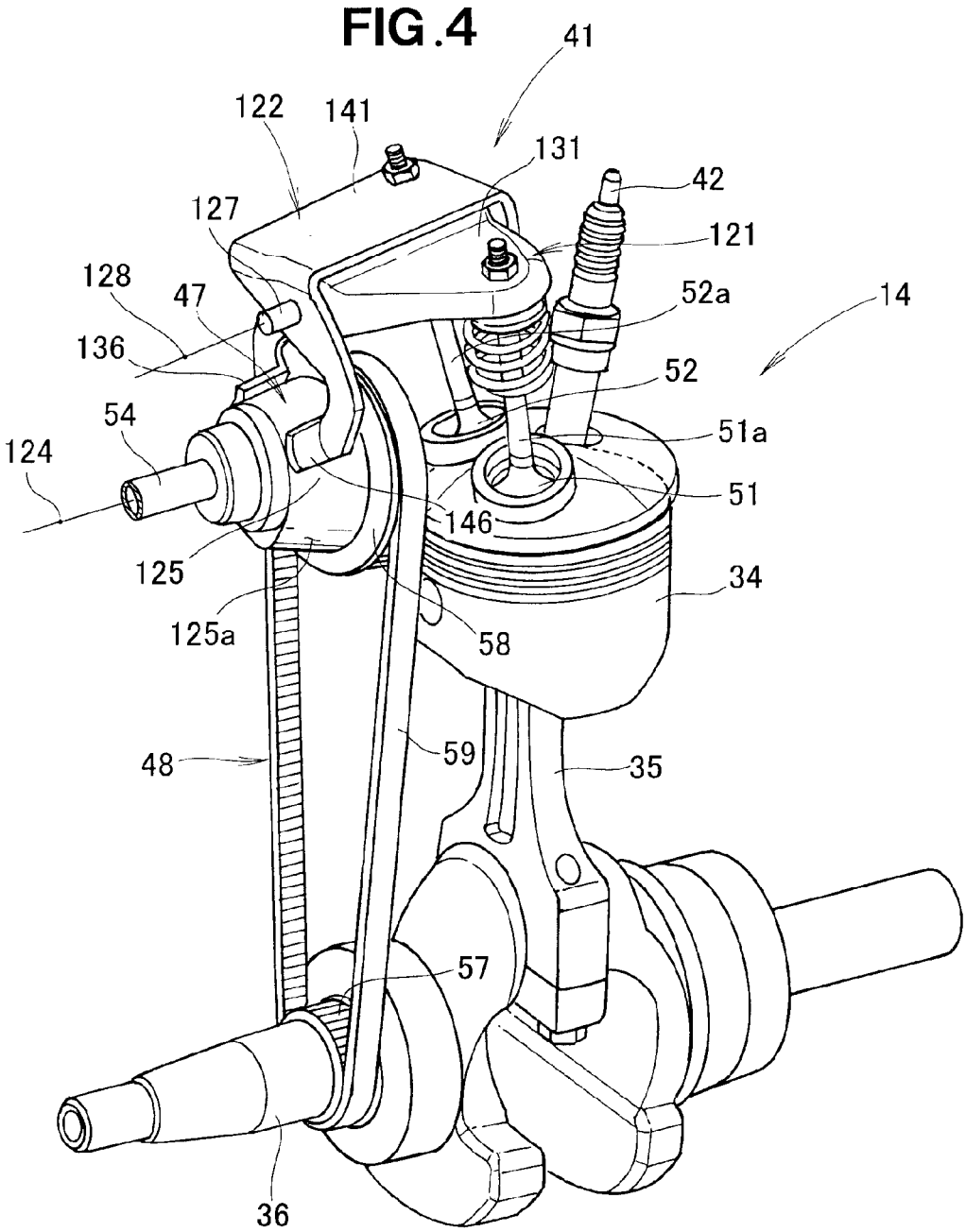
FIG. 4 is a perspective view showing a valve mechanism of FIG. 3.

The valve mechanism 41 has transmission means 48 for transmitting the rotation (motive power) of the crankshaft 36 to the cam member 47, and also has the cam member 47 formed integrally with a driven pulley 58 of the transmission means 48, an intake rocker arm 121 and an exhaust rocker arm 122 operated by the rotation of the cam member 47, the intake valve 51 linked to the intake rocker arm 121, and the exhaust valve 52 linked to the exhaust rocker arm 122, as shown in FIG. 4.

The transmission means 48 is provided with a driving pulley 57 provided to the crankshaft 36, a driven pulley 58 rotatably supported by the cooling channel 54, and an endless transmission belt (timing belt) 59 wrapped around the driving pulley 57 and the driven pulley 58.

The rotation of the driving pulley 57 is transmitted to the driven pulley 58 via the transmission belt 59 by the rotation of the crankshaft 36. The driven pulley 58 is provided coaxially with the center line (rotation center line of the cam member 47) 124 of the cooling channel 54. The rotation of the driving pulley 57 is transmitted to the driven pulley 58, whereby the driven pulley 58 is driven.

Figure 5:
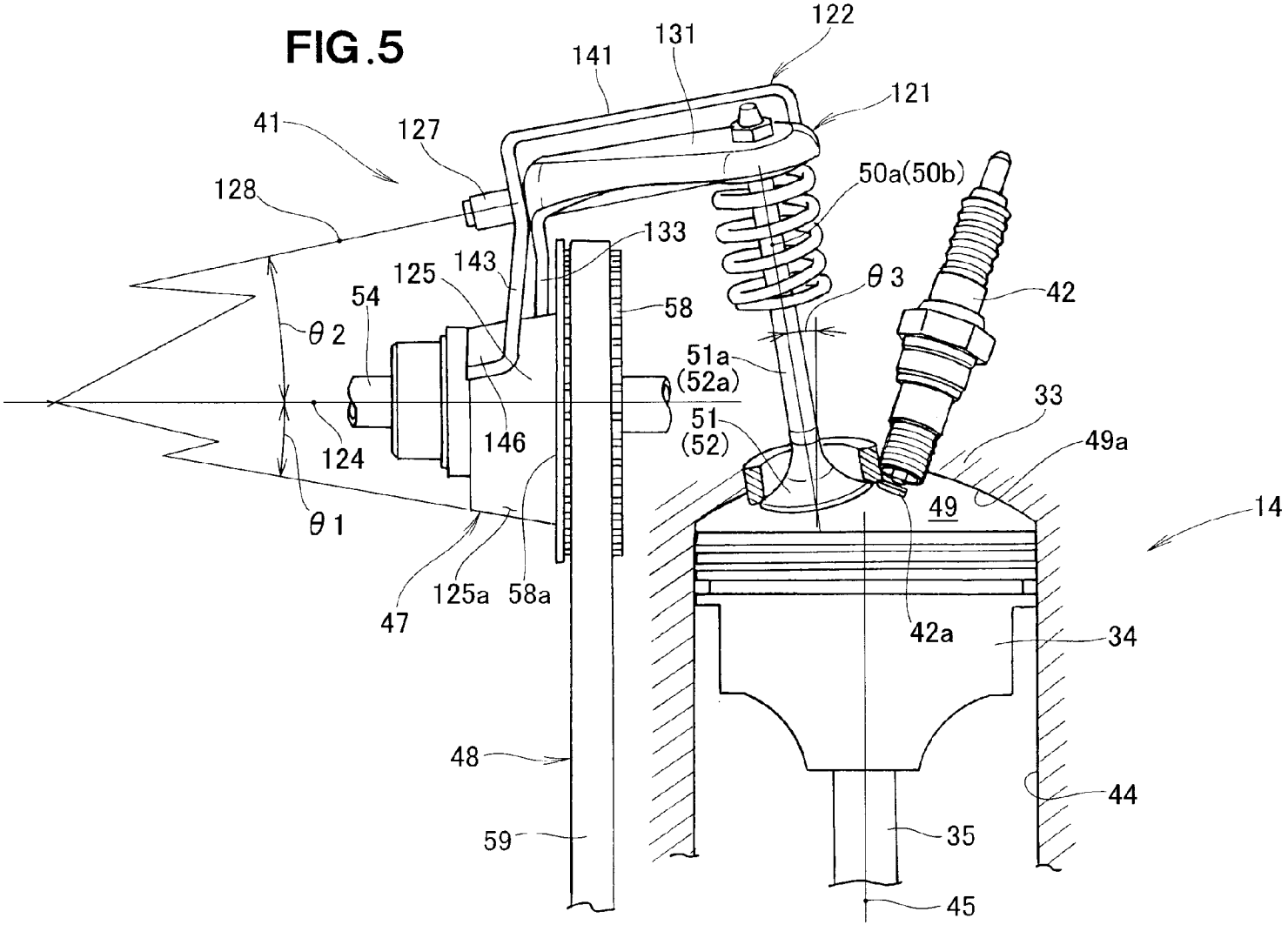
FIG. 5 is a side view of the valve mechanism of in FIG. 4.

The cam member 47 is formed integrally with the surface (specifically, outer surface) 58*a* of the driven pulley 58 that is opposite to the cylinder head 33, as shown in FIG. 5. In this state, the cam member 47 is provided coaxially with the driven pulley 58 and is rotatably supported by the cooling channel 54. The driven pulley 58 driven by the transmission belt 59 is therefore provided on the side of the cam member 47 that is near the combustion chamber 49. The driven pulley 58 and the transmission belt 59 can therefore be brought closer to the combustion chamber 49 and the cylinder 44. The valve system can thus be made compact because the driven pulley 58 and the transmission belt 59 can be brought closer to the combustion chamber 49 and the cylinder 44.

Moreover, disposing the driven pulley 58 near the combustion chamber 49 allows the cam member 47 to be disposed away from the combustion chamber 49. Arranging the cam member 47 away from the combustion chamber 49 allows the effects of the heat produced by the combustion chamber 49 to be mitigated, a tapered shape to be obtained by inclining a cam surface 125, and the driven pulley 58 and the cam member 47 to be integrally molded. The number of components can thereby be reduced, and the valve system can be made more compact.

The cam member 47 has a cam surface 125 inclined at an angle of inclination θ1 relative to the center line (rotation center line of the cam member 47) 124 of the cooling channel 54. Specifically, the cam surface 125 is formed in an inclined shape so that the diameter is reduced in accordance with the distance from the combustion chamber 49. A ridge 125*a* is formed on the cam surface 125 along part of the circumference in the same manner as on a usual cam surface.

Figure 6:
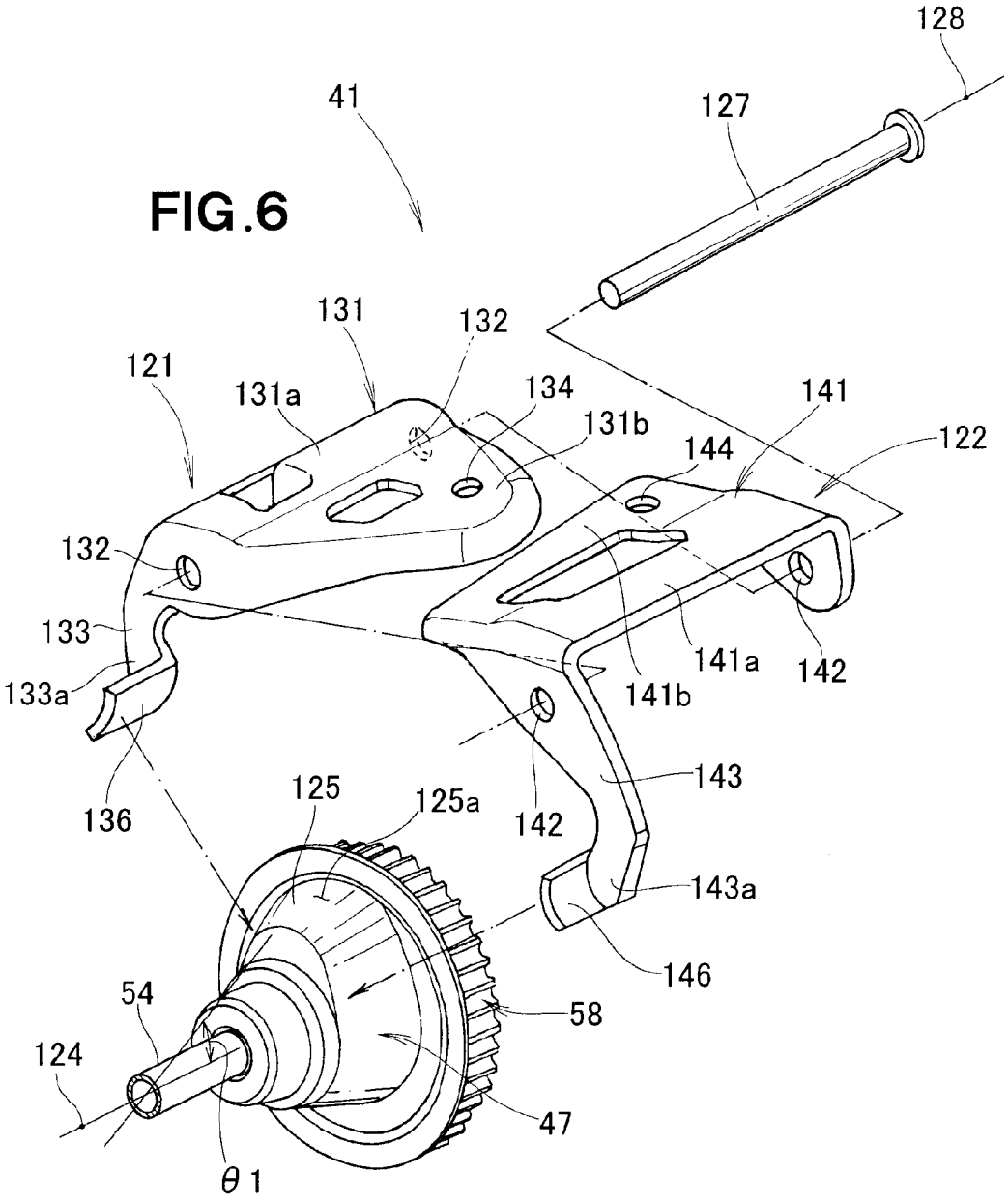
FIG. 6 is an exploded perspective view of the valve mechanism of FIG. 5.

The intake rocker arm 121 and the exhaust rocker arm 122 perform a rocking movement about a swing shaft 127 by the operation (rotation) of the cam member 47, as shown in FIGS. 4 and 6. The intake rocker arm 121 has an intake arm body 131 swingably supported by the swing shaft 127, and an intake slipper (slipper) 136 provided to the intake arm body 131.

In the intake arm body 131, a pair of through-holes 132 is provided to a base part 131*a*, an extension 133 is extended from the base part 131*a*, and a mounting hole 134 is provided to a distal end part 131*b*. The swing shaft 127 is rotatably inserted in the pair of through-holes 132, whereby the intake arm body 131 is swingably supported by the swing shaft 127. A valve rod 51*a* of the intake valve 51 is attached to the mounting hole 134 by a nut. Moreover, the intake slipper 136 is provided to a distal end 133*a* of the extension 133. The intake slipper 136 is disposed parallel to the cam surface 125 so as to be in sliding contact with the cam surface 125.

The exhaust rocker arm 122 has an exhaust arm body 141 swingably supported by the swing shaft 127, and an exhaust slipper (slipper) 146 provided to the exhaust arm body 141.

In the exhaust arm body 141, a pair of through-holes 142 is provided to a base part 141*a*, an extension 143 is extended from the base part 141*a*, and a mounting hole 144 is provided to a distal end part 141*b*. The swing shaft 127 is rotatably inserted into the pair of through-holes 142, whereby the exhaust arm body 141 is swingably supported by the swing shaft 127. The exhaust arm body 141 and the intake arm body 131 are therefore each swingably supported by a single swing shaft 127. Specifically, the center line 128 of the swing shaft 127 is aligned with the swing center line of the intake rocker arm 121 and the swing center line of the exhaust rocker arm 122.

The valve rod 52*a* of the exhaust valve 52 is attached to the mounting hole 144 by a nut. Moreover, the extension 143 is provided with the exhaust slipper 146 on a distal end 143*a* thereof. The exhaust slipper 146 is disposed parallel to the cam surface 125 so as to be in sliding contact with the cam surface 125.

In the swing shaft 127, the center line 128 (specifically, the swing center line of the intake rocker arm 121 and the swing center line of the exhaust rocker arm 122) of the swing shaft 127 is inclined at an angle of inclination θ2 (FIG. 5) relative to the center line (rotation center line of the cam member 47) 124 of the cooling channel 54.

In the above-described valve mechanism 41, the intake slipper 136 is guided by the cam surface 125, whereby the intake rocker arm 121 performs a rocking movement about the swing shaft 127. The intake valve 51 can be opened and closed by the rocking movement of the intake rocker arm 121 about the swing shaft 127.

In the same manner, the exhaust slipper 146 is guided by the cam surface 125, whereby the exhaust rocker arm 122 swings about the swing shaft 127. The exhaust valve 52 can be opened and closed by the swinging of the exhaust rocker arm 122 about the swing shaft 127.

The swing shaft 127 is inclined at the angle of inclination θ2 relative to the center line (rotation center line of the cam member 47) 124 of the cooling channel 54, as shown in FIG. 5. The intake valve 51 is provided so as to be approximately orthogonal to the intake rocker arm 121. In the same manner, the exhaust valve 52 is provided so as to be approximately orthogonal to the exhaust rocker arm 122. The intake valve 51 and the exhaust valve 52 can therefore be inclined at an angle of inclination 63 relative to the center line 45 of the cylinder 44.

Figure 7:
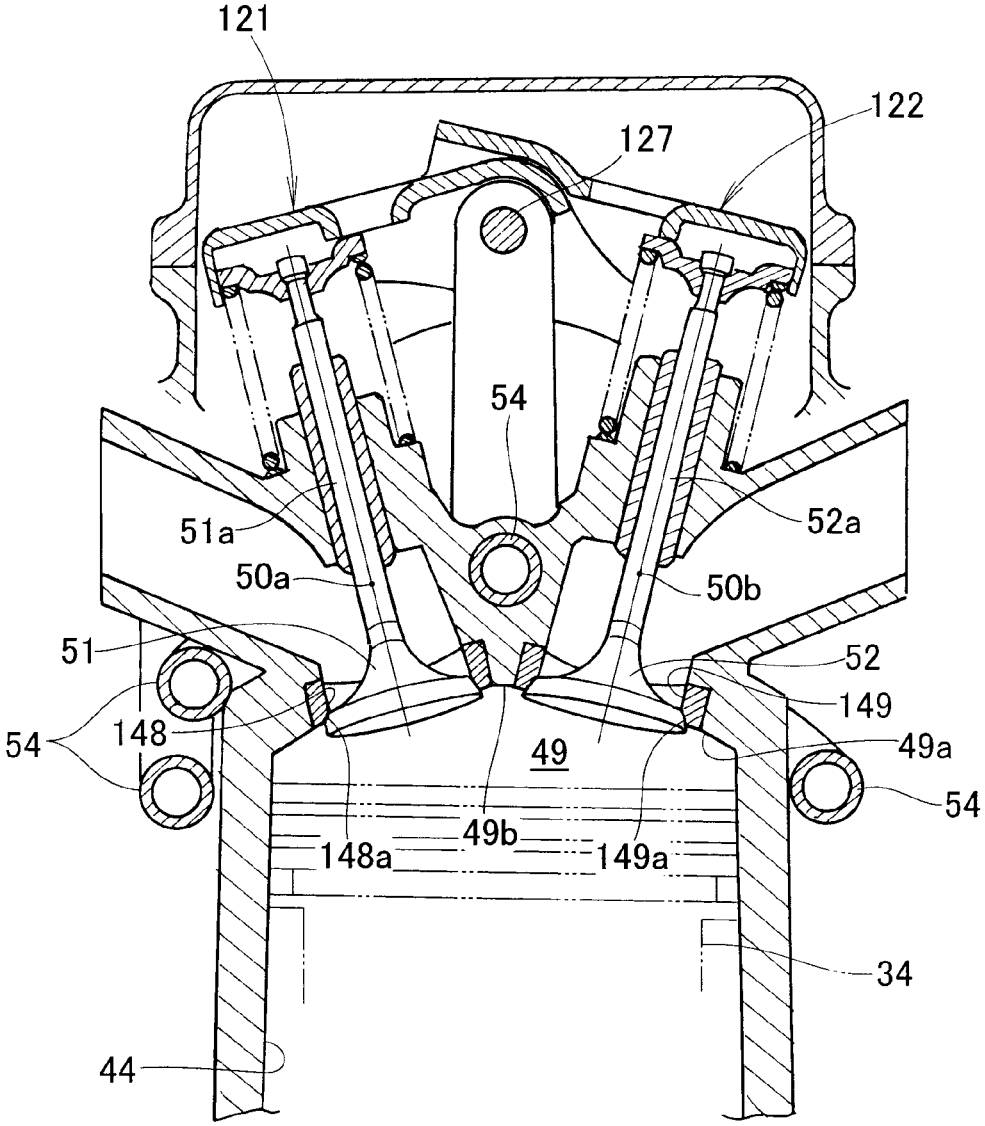
FIG. 7 is a cross-sectional view of an intake valve and an exhaust valve shown in FIG. 4.

A ceiling surface (surface opposite to the piston in the cylinder) 49*a* of the combustion chamber 49 that is opposite (facing) the piston in the cylinder can thereby be formed in an approximately hemispherical shape, as shown in FIG. 7. An intake port 148 opened and closed by the intake valve 51, and an exhaust port 149 opened and closed by the exhaust valve 52, are formed in the ceiling surface 49*a*. The intake port 148 is disposed in the direction of a normal 50*a* to the ceiling surface 49*a*. The exhaust port 149 is disposed in the direction of a normal 50*b* to the ceiling surface 49*a*. The intake valve 51 and the exhaust valve 52 can therefore be aligned with the ceiling surface 49*a*, and the surface area of the combustion chamber 49 can be minimized or the flame-quenching part (quenching zone) can be reduced.

Forming the ceiling surface 49*a* in an approximately hemispherical shape thus allows the combustion chamber 49 to be shaped to a minimum surface area. Moreover, disposing the intake port 148 (intake valve 51) in the direction of the normal 50*a* to the combustion chamber 49 allows a seat surface 148*a* of the intake valve 51 to be aligned with the front surface of the ceiling surface 49*a*. In addition, disposing the exhaust port 149 (exhaust valve 52) in the direction of the normal 50*b* to the combustion chamber 49 allows a seat surface 149*a* of the exhaust valve 52 to be aligned with the front surface of the ceiling surface 49*a*.

It is known that shaping the combustion chamber 49 to a minimum surface area, reducing the flame-quenching part (quenching zone), and aligning the seat surface 148*a* of the intake valve 51 and the seat surface 149*a* of the exhaust valve 52 with the front surface of the ceiling surface 49*a* are important factors that allow the fuel mixture to burn with high efficiency inside the combustion chamber 49. Shaping the combustion chamber 49 to a minimum surface area, reducing the flame-quenching part (quenching zone), and aligning the seat surface 148*a* of the intake valve 51 and the seat surface 149*a* of the exhaust valve 52 with the front surface of the ceiling surface 49*a* can thereby increase the combustion efficiency of the general-use liquid-cooled engine 10.

Moreover, inclining the intake valve 51 and the exhaust valve 52 relative to the center line 45 of the cylinder 44 allows the intake valve 51 and the exhaust valve 52 to be disposed clear of (offset from) the center line 45 of the cylinder 44, as shown in FIG. 5. An ignition part (distal end part) 42*a* of the spark plug 42 can therefore be provided to a top part 49*b* (FIG. 7) of the ceiling surface 49*a*. The top part 49*b* of the ceiling surface 49*a* is positioned on the center line 45 of the combustion chamber 49 and the cylinder 44, or in the vicinity of the center line 45.

In the present embodiment, the combustion chamber 49 and the cylinder 44 are described as being on the same center line 45, but the present invention may also be applied to a device in which the center line of the combustion chamber 49 is different from the center line of the cylinder 44. In such cases, the ignition part 42*a* of the spark plug 42 is preferably brought in line with the center line of the combustion chamber 49 or the vicinity of the center line.

It is known that providing the ignition part 42*a* of the spark plug 42 on the center line 45 of the combustion chamber 49 and the cylinder 44 or in the vicinity of the center line 45 is an important factor that allows the fuel mixture to burn with high efficiency inside the combustion chamber 49. Providing the ignition part 42*a* of the spark plug 42 on the center line 45 of the combustion chamber 49 and cylinder 44 or in the vicinity of the center line 45 can thereby increase the combustion efficiency of the general-use liquid-cooled engine 10.

An example of the operation of the intake valve 51 and the exhaust valve 52 of the valve mechanism 41 is described next based on FIGS. 8A and 8B.

The crankshaft 36 rotates as indicated by arrow A, whereby the piston 34 moves in the direction of arrow B, as shown in FIG. 8A. At the same time, the crankshaft 36 rotates as indicated by arrow A, whereby the transmission belt 59 is rotated by the driving pulley 57, as indicated by arrow C. The driven pulley 58 is rotated by the rotation of the transmission belt 59, as indicated by arrow D. The cam member 47 is rotated by the rotation of the driven pulley 58, as indicated by arrow D.

The intake slipper 136 is moved as indicated by arrow E by the rotation of the cam member 47, as shown in FIG. 8B. The intake slipper 136 moves as indicated by arrow E, whereby the intake rocker arm 121 swings about the swing shaft 127 as indicated by arrow F. The intake valve 51 is moved up and down by the swinging of the intake rocker arm 121, as indicated by arrow G.

At the same time, the exhaust slipper 146 is moved by the rotation of the cam member 47, as indicated by arrow H. The exhaust slipper 146 moves as indicated by arrow H, whereby the exhaust rocker arm 122 swings about the swing shaft 127, as indicated by arrow I. The exhaust valve 52 is moved up and down by the swinging of the exhaust rocker arm 122, as indicated by arrow J.

An example is described next in which the increase and decrease in the valve lift rate (ascending/descending rate) of the intake valve 51 and the exhaust valve 52 is adjusted by the movement of the cam member 47 along the cooling channel 54 in the valve-mechanism-equipped engine 10. The description is based on FIG. 9.

Figure 9:
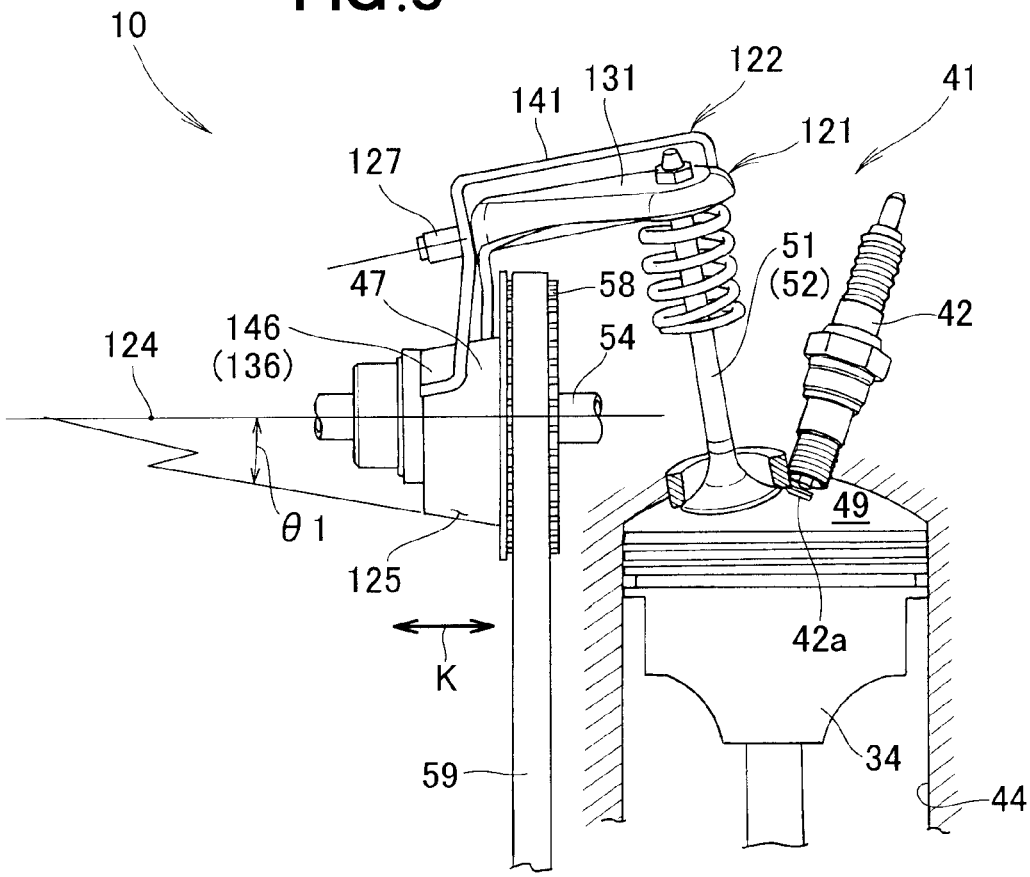
FIG. 9 is a view showing an example in which an increase/decrease in a valve lift rate of the intake valve and the exhaust valve of FIG. 4 is adjusted.

The cam surface 125 of the cam member 47 is inclined at the angle of inclination θ1 relative to the center line (rotation center line of the cam member 47) 124 of the cooling channel 54, as shown in FIG. 9. Moreover, the intake slipper 136 and the exhaust slipper 146 are in sliding contact with the inclined cam surface 125. Accordingly, moving the cam member 47 along the cooling channel 54 as indicated by arrow K allows the increase and decrease in the valve lift rate (ascending/descending rate) of the intake valve 51 and the exhaust valve 52 to be adjusted. In addition, moving the cam member 47 along the cooling channel 54 as indicated by arrow K allows the cam member to perform the role of a lash adjuster mechanism.

The lash adjuster mechanism is a mechanism for appropriately maintaining the characteristics of the valve-mechanism-equipped engine 10 by adjusting the clearance in cases in which, for example, the peripheral components of the cam member 47 have a large clearance.

The valve-mechanism-equipped engine according to the present invention is not limited to the present embodiments and may be appropriately modified, improved, and the like. For example, a general-use water-cooled engine is used in the present embodiment as an example of a general-use liquid-cooled engine, but another liquid may be used as the cooling liquid.

Moreover, an example is given in the present embodiment of an engine in which the center line of the combustion chamber 49 and the center line of the cylinder 44 are the same center line 45, but the embodiment is not limited to this example, and the present invention may be applied to an engine in which the center line of the combustion chamber 49 is different from the center line of the cylinder 44. In such cases, the ignition part 42*a* of the spark plug 42 is preferably brought in line with the center line of the combustion chamber 49 or the vicinity of the center line.

The shape and structure of the valve-mechanism-equipped engine 10, the piston 34, the crankshaft 36, the spark plug 42, the cylinder 44, the cam member 47, the transmission means 48, the combustion chamber 49, the ceiling surface 49*a*, the intake valve 51, the exhaust valve 52, the cooling channel 54, the driving pulley 57, the driven pulley 58, the transmission belt 59, the intake rocker arm 121, the exhaust rocker arm 122, the cam surface 125, the intake slipper 136, the exhaust slipper 146, the intake port 148, the exhaust port 149, and the like disclosed in the present embodiment are not limited to the examples, and may be appropriately modified.

The present invention is preferably applied to a valve-mechanism-equipped engine adapted to operate an intake valve and an exhaust valve of a combustion chamber by driving a cam to open and close the combustion chamber.

Obviously, various minor changes and modifications of the present invention are possible in light of the above teaching. It is therefore to be understood that within the scope of the appended claims the invention may be practiced otherwise than as specifically described.

What is claimed is:

1. A valve-mechanism-equipped engine, comprising:

an intake rocker arm for opening and closing an intake valve of a combustion chamber;

an exhaust rocker arm for opening and closing an exhaust valve of the combustion chamber;

a cam for driving the intake rocker arm and the exhaust rocker arm; and transmission means for transmitting motive power of a crankshaft to the cam, wherein the intake rocker arm and the exhaust rocker arm have a swing center line inclined relative to a rotation center line of the cam, wherein the cam has a cam surface inclined relative to the rotation center line of the cam, wherein the intake rocker arm and the exhaust rocker arm are provided with slippers that are in sliding contact with the cam surface, wherein the slippers are guided by the cam surface such that the intake rocker arm and the exhaust rocker arm swing about the swing center line, wherein the transmission means comprises:

a driving pulley provided to the crankshaft;

a driven pulley provided coaxially with the rotation center line of the cam; and a transmission belt trained around the driving pulley and the driven pulley, and wherein the driven pulley is provided in a direction of the combustion chamber in relation to the cam.

2. The engine of claim 1, wherein a surface of the combustion chamber, opposed to a piston of a cylinder, is formed in a substantially hemispherical shape, and an intake port opened and closed by the intake valve, and wherein an exhaust port opened and closed by the exhaust valve are formed in a direction normal to the substantially hemispherical surface.

3. The engine of claim 2, wherein the substantially hemispherical surface is provided with a spark plug on a center line of the combustion chamber and the cylinder or in a vicinity of the center line.

* * * * *